US009546568B2

(12) United States Patent
Kanzaka et al.

(10) Patent No.: US 9,546,568 B2
(45) Date of Patent: Jan. 17, 2017

(54) COOLING STRUCTURE OF BEARING HOUSING FOR TURBOCHARGER

(75) Inventors: Tadashi Kanzaka, Tokyo (JP); Kenichiro Iwakiri, Tokyo (JP); Hiroshi Ogita, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 75 days.

(21) Appl. No.: 14/117,795

(22) PCT Filed: Jun. 22, 2012

(86) PCT No.: PCT/JP2012/066030

§ 371 (c)(1),
(2), (4) Date: Dec. 16, 2013

(87) PCT Pub. No.: WO2013/002147

PCT Pub. Date: Jan. 3, 2013

(65) Prior Publication Data

US 2014/0090375 A1 Apr. 3, 2014

(30) Foreign Application Priority Data

Jun. 30, 2011 (JP) ..... 2011-145859

(51) Int. Cl.
*F02B 33/44* (2006.01)
*F01D 25/12* (2006.01)
(Continued)

(52) U.S. Cl.
CPC ..... *F01D 25/125* (2013.01); *F01D 25/14* (2013.01); *F02B 39/005* (2013.01); *F05D 2220/40* (2013.01); *F05D 2260/232* (2013.01)

(58) Field of Classification Search
CPC ..... F02B 39/00; F02B 39/14; F01D 25/125; F01D 25/14; F01D 25/16; F01D 25/186; F05B 2220/40; F01M 2011/021
(Continued)

(56) References Cited

U.S. PATENT DOCUMENTS 4,376,617 A * 3/1983 Okano et al. ..... 417/407
4,927,336 A * 5/1990 Rossmann et al. ..... 417/407
(Continued)

FOREIGN PATENT DOCUMENTS

CN 101008344 A 8/2007
CN 101943034 A 1/2011
(Continued)

OTHER PUBLICATIONS

International Preliminary Report on Patentability of PCT/JP2012/066030 dated Jan. 16, 2014 with an English translation.
(Continued)

*Primary Examiner* — Thomas Denion
*Assistant Examiner* — Matthew T Largi
(74) *Attorney, Agent, or Firm* — Birch, Stewart, Kolasch & Birch, LLP

(57) ABSTRACT

A cooling structure for a bearing housing for a turbocharger is provided. The cooling structure is configured so that the cooling structure has improved productivity, the occurrence of heat soak-back is reduced, and the cooling structure has improved cooling performance. The cooling structure cools both a bearing housing 13 and a bearing 52 by cooling water flowing through an annular cooling water path 13*f* formed in the bearing housing 13, and is provided with: a water path inlet 13*h* for supplying the cooling water and a water path outlet 13*j* for discharging the cooling water, which are provided in the bearing housing 13 to communicate with the annular cooling water path 13*f*; and a partial partition 14*a* in
(Continued)

the bearing housing 13 to partially close a water path which forms the shortest route between the water path inlet 13*h* and the water path outlet 13*j*.

5 Claims, 7 Drawing Sheets

(51) Int. Cl.
*F01D 25/14* (2006.01)
*F02B 39/00* (2006.01)

(58) Field of Classification Search
USPC ..... 60/605.3; 417/406–407; 184/6.11
See application file for complete search history.

(56) References Cited

U.S. PATENT DOCUMENTS

| | | | | |
|---|---|---|---|---|
| 5,161,960 | A * | 11/1992 | Smith | 417/407 |
| 2004/0200215 | A1* | 10/2004 | Woollenweber et al. | 60/407 |
| 2008/0087018 | A1* | 4/2008 | Woollenweber | F01D 25/16 60/605.3 |
| 2012/0003081 | A1* | 1/2012 | Woollenweber | F01D 5/082 415/180 |
| 2012/0014782 | A1* | 1/2012 | Petitjean | F01D 25/14 415/170.1 |
| 2013/0205775 | A1* | 8/2013 | Begin et al. | 60/605.3 |
| 2013/0323020 | A1* | 12/2013 | Bogner | F01D 25/14 415/116 |

FOREIGN PATENT DOCUMENTS

| | | | | |
|---|---|---|---|---|
| DE | 32 35 538 | A1 | 3/1984 | |
| EP | 0 270 384 | A2 | 6/1988 | |
| JP | 62-284922 | A | 12/1987 | |
| JP | 5-79344 | A | 3/1993 | |
| JP | 05079344 | A * | 3/1993 | F02B 39/00 |
| JP | 5-141259 | A | 6/1993 | |
| JP | 2009-79497 | A | 4/2009 | |
| JP | 2010-196478 | A | 9/2010 | |
| JP | 2011-69367 | A | 4/2011 | |

OTHER PUBLICATIONS

International Search Report for PCT/JP2012/066030.
Extended European Search Report dated Jan. 28, 2015 issued in corresponding European Application No. 12 80 5188.5.
Chinese Office Action dated May 6, 2015 for corresponding Chinese Application No. 201280026210.7 with an English translation.
Chinese Office Action dated Dec. 14, 2015 for corresponding Chinese Application No. 201280026210.7 with an English translation.
Japanese Decision to Grant a Patent, dated Mar. 4, 2016, for corresponding Japanese Application No. 2011-145859, with an English translation.
Chinese Notice of Allowance, dated Oct. 8, 2016, for Chinese Application No. 201280026210.7, including an English translation.

* cited by examiner

First Embodiment

First Embodiment

First Comparative Example

First Comparative Example

Second Comparative Example

Second Comparative Example

First Embodiment

First Embodiment

First Comparative Example

First Comparative Example

Second Comparative Example

Second Comparative Example

COOLING STRUCTURE OF BEARING HOUSING FOR TURBOCHARGER

TECHNICAL FIELD

The present invention relates to a cooling structure for a bearing housing which rotatably supports a turbine rotor and a compressor of a turbocharger and, in particular to, improvement of a cooling water path formed in a bearing housing.

BACKGROUND ART

There are bearing housings for a turbocharger, which are provided with a cooling structure using water or air to protect from a high temperature environment caused by exhaust gas a supporting part of a shaft which integrally connects a turbine rotor to a compressor.

For instance, there is a cooling structure configured to promote a flow of cooling water in a water jacket by connecting an inlet and an outlet of a circulation water passage to the water jacket and providing a partition board at the connection part to partition the passage into an inlet side and an outlet side (Patent Document 1). There is another cooling structure in which a top part partitioning wall is provided at a top part of a cooling water jacket and an inlet and an outlet for cooling water are formed in both sides with respect to the partitioning wall (Patent Document 2).

According to FIG. 1 and FIG. 4 of Patent Document 1, a water jacket 7 is formed in a center housing 6, and a water passage flange 1 is attached to the center housing 6 to face the water jacket 7. Further, in this water passage flange, a water inlet passage 2 for introducing cooling water into the water jacket 7 and a water outlet passage 3 for discharging the cooling water from the water jacket 7 are provided, and a partition board 5 is provided in the water passage flange 1 to project inside the water jacket 7 and separate a water inlet passage 2 and a water outlet passage 3.

According to FIG. 1 and FIG. 2 of Patent Document 2, a cooling water jacket 31 is formed in a bearing housing 3 to have a loop shape surrounding the entire circumference of the turbine shaft 5, and the top part partitioning wall 32 is formed on the cooling water jacket 31 to partially close the loop shape of the cooling jacket 31, and the inlet 33 and the outlet 34 of cooling water are formed in the bearing housing 3 to communicate with the cooling water jacket 31 at a position where the top part portioning wall 32 is interposed between the inlet 33 and the outlet 34

CITATION LIST

Patent Literature

[Patent Document 1]JP 62-284922 A
[Patent Document 2]JP 5-141259 A (JP 2924363 B)

SUMMARY

Technical Problem

In Patent Document 1, by providing the portioning board 5, the cooling water introduced to the water inlet passage 2 is regulated by the portioning board 5, and it is made easier for the cooling water to flow along a peripheral wall of the water jacket 16. However, the water passage flange 1 is fixed to the center housing 6 with a plurality of screws 4 and thus, the number of parts is large and the productivity is low.

Further, when a water pump stops during engine shutdown, the portioning board 5 hinders occurrence of natural convection in the water inlet passage 2, the water jacket 7 and the water outlet passage 3, respectively. Thus, under a harsh temperature environment due to the heat transferred from the turbine side to the center housing 6 and the turbine shaft 13 during operation of the engine, a heat-soak back phenomenon takes place, and a radial metal 12 becomes subjected to high temperature, resulting in carbonization of the lubricating oil around a radial metal 12.

In Patent Document 2, the cooling water jacket 31 is partitioned in the upper part by the top part portioning wall 32 and thus, the cooling water flow tends to stagnate in a section of the cooling water jacket 31 between the inlet 33 and the outlet 34 of the cooling water jacket 31 and the top part portioning wall 32. If the air gets mixed in the cooling water, the air tends to accumulate in the above section, resulting in reduced cooling performance. Further, the above-mentioned heat-soak back phenomenon is likely to occur.

Moreover, in the case of casting the bearing housing 3, as the cooling water jacket 31 is partitioned by the top part portioning wall 32, it is difficult to discharge core sand in the cooling water jacket 31, resulting in a productivity issue.

It is an object of the present invention to provide a cooling structure for a bearing housing for a turbocharger, which makes it possible to improve cooling performance while improving productivity and suppressing occurrence of a heat-soak back phenomenon.

Solution to Problem

To achieve the above object, the present invention provides a cooling structure for a bearing housing for a turbocharger in which a turbine housing for housing a turbine rotor is attached to a compressor housing for housing a compressor rotor via the bearing housing, the turbine rotor and the compressor is connected by a shaft and the shaft is rotatably supported via the bearing in the bearing housing, the cooling structure comprising:

an annular cooling water path formed in the bearing housing and surrounding the shaft and the bearing so as to cool the bearing housing and the bearing with cooling water flowing in the annular cooling water path;

a water path inlet provided in the bearing housing to communicate with the annular cooling water path, the cooling water being supplied to the annular cooling water path from the water path inlet;

a water path outlet provided in the bearing housing to communicate with the annular cooling water path, the cooling water being discharged from the water path outlet; and a partial partition for partially closing a water path disposed between the water path inlet and the water path outlet, and the partial partition is arranged in a shortest path of the water path between the water path inlet and the water path outlet.

According to the present invention, by means of the partial partition, the cooling water supplied to an interior of the bearing housing from the water path inlet flows to the annular cooling water path without directly flowing to the water path outlet. As a result, the circulating amount of the cooling water in the annular cooling water path increases.

By arranging the partial partition in the shortest bath between the water path inlet and the water path outlet, the cooling water does not flow directly to the water path outlet from the water path inlet. This facilitates the flow of the cooling air passing outside the partial partition wall and to the annular cooling water path side so as to increase the circulation amount of the cooling water in the annular cooling water path.

With the above configuration, it is possible to facilitate heat transfer to the cooling water in the bearing, the bearing housing and the annular cooling water path from the shaft. As a result, the cooling performance of cooling the bearing can be enhanced.

Moreover, the annular cooling water path is not completely closed by the partial partition and thus, in the case of producing the bearing housing by casting and forming the annular cooling water path using a sand mold core, core sand can be easily removed by shot blasting. As a result, it is possible to improve the productivity of the bearing housing and reduce the cost.

Further, when a water pump stops during engine shutdown, forced circulation of the cooling water in the annular cooling water path is stopped. However, by providing the partial partition, natural convection of the cooling water occurs through unclosed sections of the water path between the water path inlet and the water path outlet and the annular cooling water path. As a result, it is possible to secure the cooling performance, and the heat soak-back phenomenon does not easily occur, hence avoiding carbonization of the lubricant circulating in the bearing.

Furthermore, the air that enters the water path between the water path inlet and the water path outlet and the annular cooling water path is discharged through the unclosed section of the water path. Therefore, reduction in cooling ability caused by air entrainment can be avoided to secure the cooling performance.

In the present invention, the cooling structure may further comprise:

a side water path arranged to be offset in an axial direction with respect to the annular cooling water path, in the side water path, the water path inlet and the water path outlet being provided and the shortest path being formed, and the partial partition is arranged at a height in the flow path formed by the annular cooling water path and the side water path, the height being 20 to 80% of an axial height of the flow path along the axial direction of the flow path.

According to the present invention, by setting the height of the partial partition in the axial direction to 20 to 80% of an axial height of the flow path along the axial direction of the flow path, the circulating amount of the cooling water in the annular cooling water path can be changed by changing a shape and size of the annular cooling water path, positions and inner diameters of the water path inlet and the water path outlet, and the number of the water path inlets and the water path outlets. Therefore, the circulating amount of the cooling water in the annular cooling water path can be adjusted in accordance with use conditions of the turbocharger.

It is preferable in the present invention that the partial partition is configured to almost completely close the side water path at said axial height.

With this configuration, the cooling water entering the side water path through the water path inlet flows in the axial direction along the partial partition, reaches the annular cooling water path and then flows along the partial partition to the water path outlet to flow out of the side water path. As a result, it is possible to facilitate the cooling water circulation in the annular cooling water path and improve the cooling performance.

In the present invention, the partial partition may have an inclined face inclining relative to the axial direction of the shaft so as to facilitate a flow of the cooling water to the annular cooling water path from the water path inlet or to the water path outlet from the annular cooling path.

By providing the inclined face in the partial partition, the cooling water can flow easily from the water path inlet to the annular cooling water path, or from the annular cooling water path to the water path outlet. Therefore, the circulating cooling water amount in the annular cooling water path can be increased to improve the cooling performance.

In the present invention, plural sets of the water path inlet and the water path outlet may be provided, and the partial partition may be provided in each of the plural sets of the water path inlet and the water path outlet.

With this configuration, it is made easy to select a set from the plural sets of the water path inlet and the water path outlet, which is at a position corresponding to an engine where the turbocharger is to be mounted. Therefore, regardless of the water path inlet and outlet of each engine model, it is possible to enhance stability of the cooling performance of the turbocharger.

Further, in the present invention, the partial partition may be divided into a plurality of sections.

By dividing the partial partition into a plurality of sections, the cooling air entering through the water path inlet can be easily introduced to the annular cooling water path, and the circulation cooling water amount in the annular cooling water path can be further increased.

Advantageous Effects

According to the present invention, the cooling water supplied to the turbine housing through the water path inlet can be circulated in the annular cooling water path by means of the partial partition. Thus, it is possible to facilitate circulation of the cooling water in the annular cooling water path and increase the circulating water amount. Therefore, it is possible to facilitate heat transfer to the cooling water in the bearing, the bearing housing and the annular cooling water path from the shaft. As a result, the cooling performance of cooling the bearing can be enhanced.

Further, the annular cooling water path is not closed by the partial partition and thus, in the case of producing the bearing housing by casting and forming the annular cooling water path using a sand mold core, core sand can be easily removed by shot blasting. Therefore, it is possible to improve the productivity of the bearing housing and reduce the cost.

Furthermore, even when the water pump stops during engine shutdown, natural convection of the cooling water occurs in the water path between the water path inlet and the water path outlet and the annular cooling water path. As a result, it is possible to secure the cooling performance, and the heat soak-back phenomenon does not occur easily, hence avoiding carbonization of the lubricant which circulates in the bearing.

Moreover, the air that enters the water path between the water path inlet and the water path outlet and the annular cooling water path can be easily discharged. Therefore, reduction in cooling ability caused by air entrainment can be avoided so as to maintain the cooling performance.

Further, by providing plural sets of the water path inlet and the water path outlet, it is possible to enhance the cooling performance stability of the turbocharger regardless of the water path inlet and outlet of each engine model. By making it as a casting having plurality sets of the water path inlet and the water path outlet, the single casting can be used flexibly for a variety of water supply discharge layouts.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

First Embodiment

Figure 1:
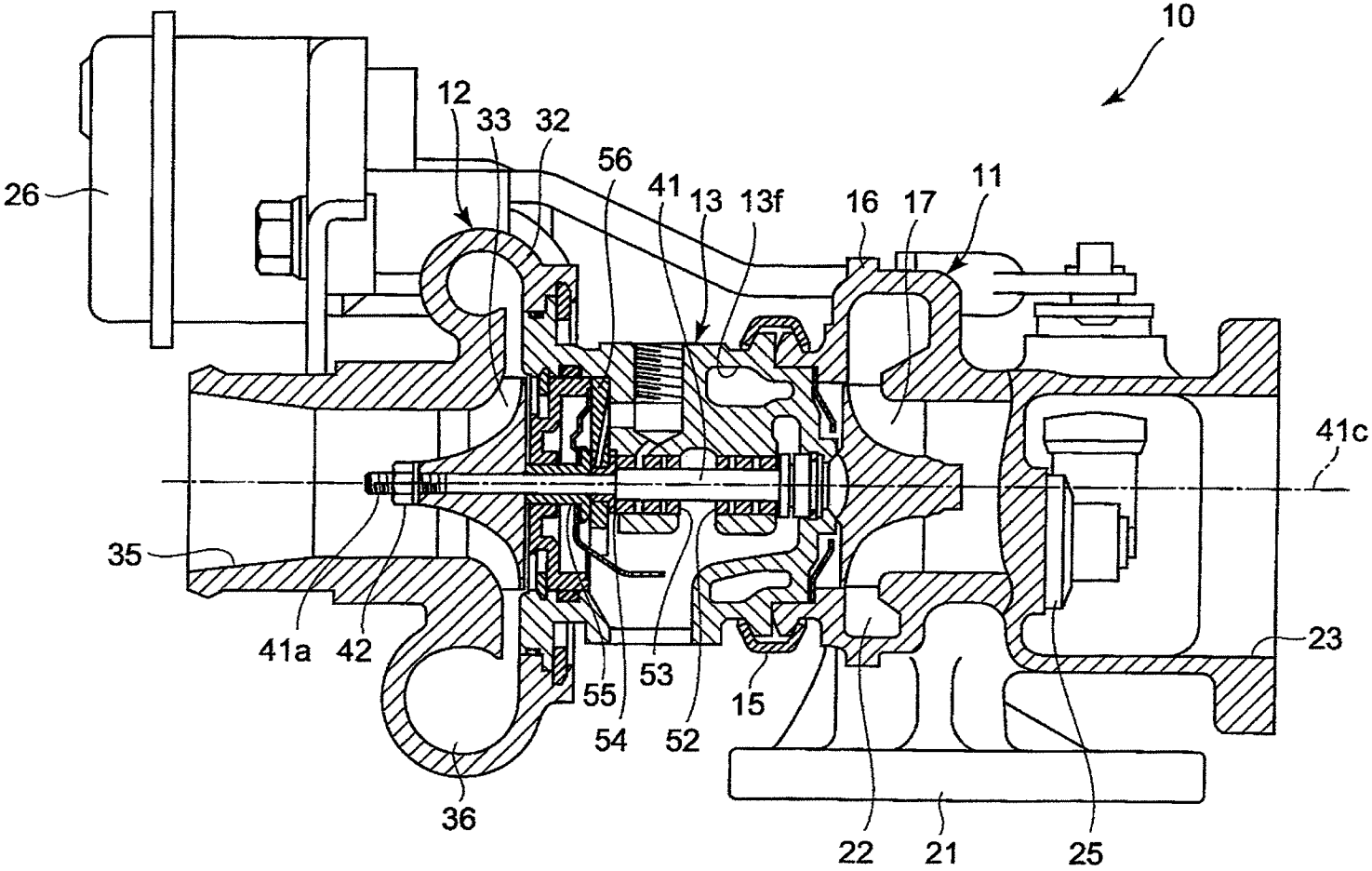
FIG. 1 is a cross-sectional view of a turbocharger according to the present invention.

As illustrated in FIG. 1, a turbocharger 10 is mainly composed of a turbine 11 which is driven by energy of exhaust gas exhausted from an engine, a compressor 12 which generates pressurized air using the rotational force of the turbine 11 as a driving force and supplies the pressurized air to an engine intake system, a bearing housing 13 provided between the turbine 11 and the compressor 12, a plurality of journal bearings 52, 53 provided inside the bearing housing 13, and a shaft which connects connecting the turbine 11 and the compressor 12 and is rotatably supported by the journal bearings 52, 53.

The turbine 11 is provided with a turbine housing 16 coupled to an end of the bearing housing 13 by a coupling member 15 and a turbine rotor 17 rotatably housed in the turbine housing 16.

The turbine housing 16 is formed by an exhaust gas introduction port 21, a scroll part 22 and an exhaust gas exhaust port 23 are formed. The scroll part 22 is an exhaust gas passage which is formed into a scroll shape from the exhaust gas introduction port 21 and which gradually decreases in cross-sectional area toward the turbine rotor 17.

Further, a wastegate valve 25 is provided to regulate the amount of the exhaust gas supplied to the turbine rotor 17 by diverting a part of the exhaust gas, and an actuator 26 is provided to open and close the wastegate valve 25.

The compressor 12 is provided with a compressor housing 32 coupled to the other end of the bearing housing 13 and a compressor rotor 33 rotatably housed in the compressor housing 32.

In the compressor housing 32, a compressor introduction port 35 for introducing the air, a scroll part 36 formed into a scroll shape and a compressor exhaust port (not shown) are formed. The scroll part 36 communicates with the compressor introduction port 35. The compressor exhaust port is connected to the engine side to discharge the air.

One end of the shaft 41 is attached to the turbine rotor 17 and the other end of the shaft 41 is formed into a male screw 41*a*. With this male screw 41*a* and a nut 42, the compressor rotor 33 is attached to the other end of the shaft 41.

The shaft 41 is rotatably supported by bearing housing 13 via the journal bearings 52, 53.

Figure 2:
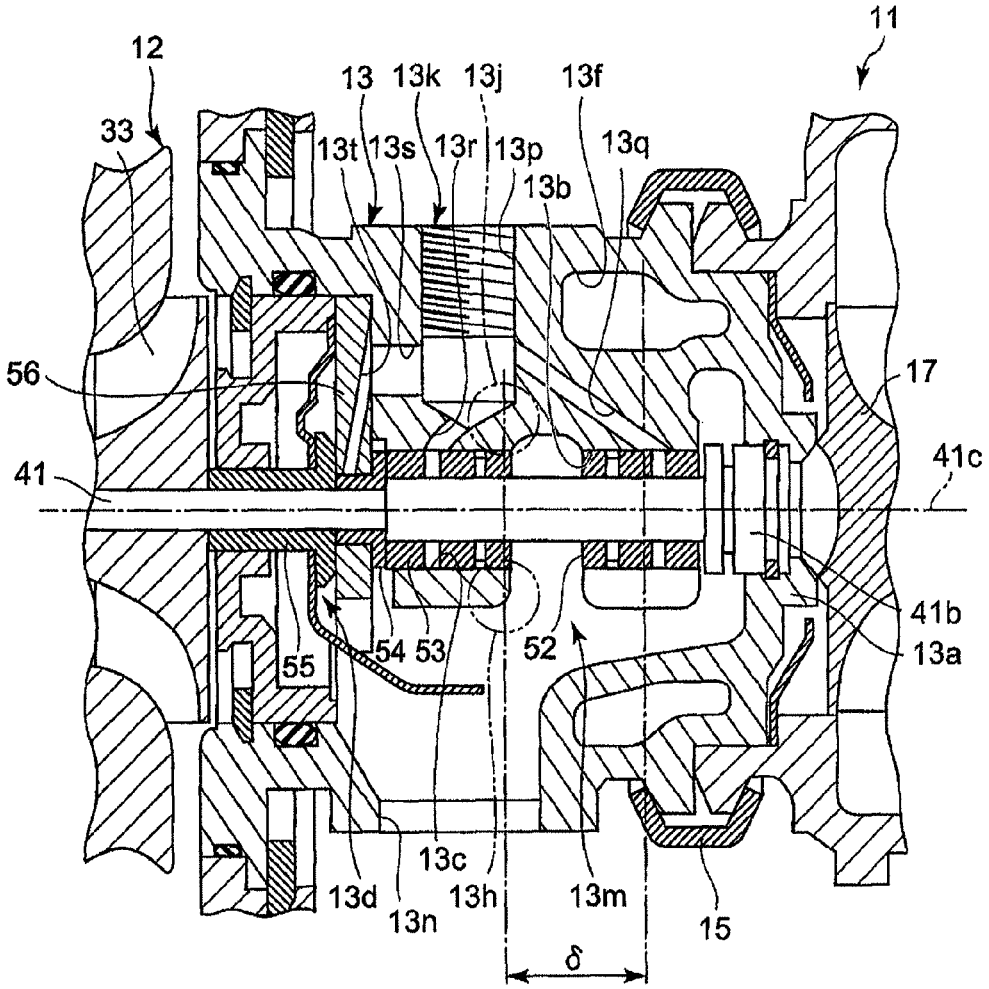
FIG. 2 is a cross-sectional view of a main section of a cooling structure for a bearing housing for a turbocharger according to the present invention.

As illustrated in FIG. 2, the bearing housing 14 is formed by a shaft supporting part 13*a* for rotatably supporting an enlarged-diameter portion 41*b* provided at an end of the shaft 41 on the turbine rotor 17 side, bearing fitting holes 13*b*, 13*c* to which the bearings 52, 53 are fitted, a bearing housing part 13*d* where a thrust ring 54 and a thrust sleeve 55 are arranged, an annular cooling water path 13*f* formed annularly around the bearing 52, a water path inlet 13*h* through which the cooling water is supplied to the annular cooling water path 13*f*, a water path outlet 13*j* through which the cooling water is discharged from the annular cooling water path 13*f*, a lubricant supply path 13*k* through which a lubricant is supplied to the journal bearings 52, 53, a space 13 forming a passage for discharging the lubricant and a lubricant exhaust port 13*n* formed below the space 13*m* to discharge the lubricant to the outside.

To cool a part of the bearing housing 13 and the bearings 52, 53 which is on the side nearer to the turbine 11, the annular cooling water path 13*f* is arranged to overlap an inner side of the coupling member in an extending direction of an axis 41*c* of the shaft 41 (an axial direction of the shaft 41), and the water path inlet 13*h* and the water path outlet 13*j* are arranged to be offset by an offset amount 6 in the axial direction of the shaft 41 with respect to the annular cooling water path 13*f* and in the direction of moving away from the turbine 11.

The lubricant supply path 13*k* is formed by a lubricant introduction port 13*p* for introducing the lubricant and a plurality of oil paths 13*q*, 13*r*, 13*s*, 13*t* which branch from the lubricant introduction port 13*p*. Through these oil paths 13*q*, 13*r*, 13*s*, 13*t*, the lubricant is supplied to sliding parts of the journal bearings 52, 53 and the thrust bearing 56.

After lubricating the sliding part of each of the bearings 52 to 55, the lubricant oil is allowed to escape to the space 13*m* from the sliding part to be discharged through the lubricant exhaust port 13*n* and then returned to an oil pan of the engine.

Figure 3:
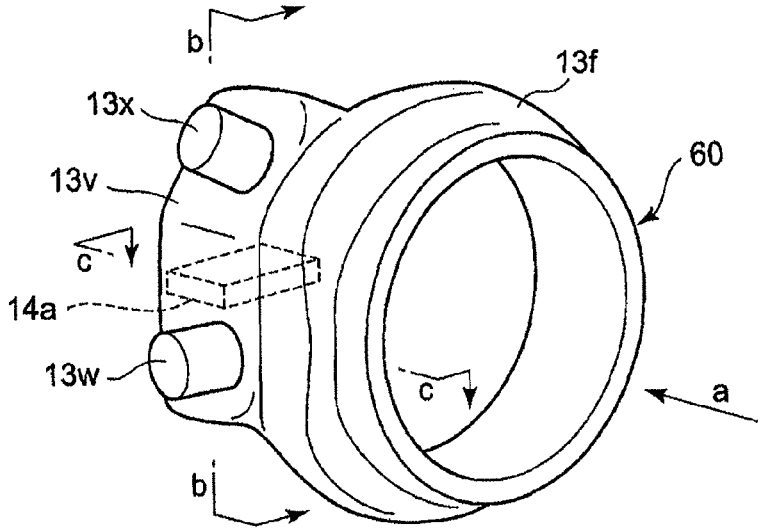
FIG. 3 is an oblique view of a cooling water path of the bearing housing according to the present invention.

FIG. 3 illustrates configurations of the annular cooling water path 13*f*, a side water path 13*v* communicating with a side part of the annular cooling water path 13*f*, and an inlet side water path 13*w* and an outlet side water path 13*x* which communicate with the side water path 13*v*. The annular cooling water path 13*f*, the side water path 13*v*, the inlet side water path 13*w* and the outlet side water path 13*x* form a housing cooling water path 60.

Figure 4A:
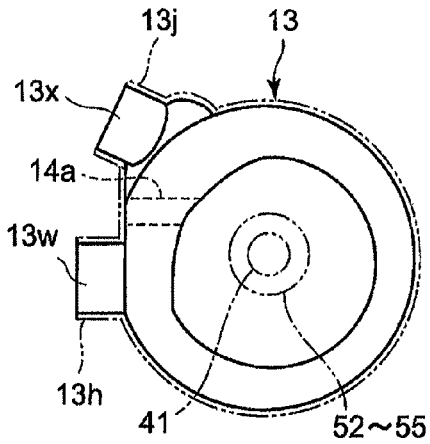
FIG. 4A is a view of the cooling water path of the bearing housing taken in the direction of an arrow a of FIG. 3.

FIG. 4A is a view of the cooling water path of the bearing housing taken in the direction of an arrow a of FIG. 3. An outline of the bearing housing 13 is indicated by a two-dot chain line.

The inlet side water path 13*w* is formed in the water path inlet 13*h*, and the outlet side water path 13*x* is formed in the water path outlet 13*j*.

Figure 4B:
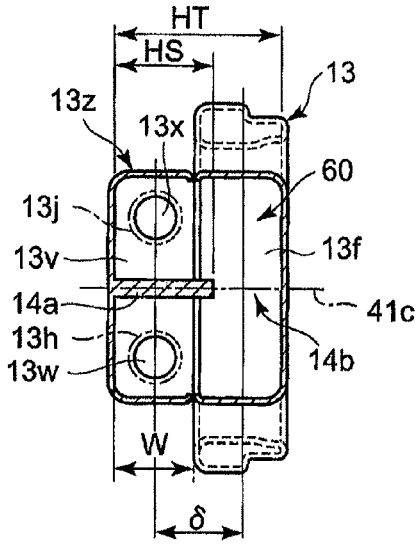
FIG. 4B is a cross-sectional view taken along line b-b of FIG. 3.

FIG. 4B is a cross-sectional view taken along line b-b of FIG. 3. In the drawing, the housing cooling water path 60 and a peripheral wall surrounding the housing cooling water path 60 are schematically illustrated, and the cross section of the peripheral wall is hatched.

On a side of the annular cooling water path 13*f*, a port part 13*z* where the side water path 13*v* is formed is provided. In this port part 13*z*, the water path inlet 13*h* and the water path outlet 13*j* are provided.

The side water path 13*v* allows communication between: the water path inlet 13*h* and the water path outlet 13*j*; and the annular cooling water path 13*f*.

In the port part 13*z*, a partial partition 14*a* is integrally formed in the bearing housing 13. The partial partition 14*a* is arranged at a position higher than the inlet side water path 13*w* and lower than the outlet side water path 13*x*. The partial partition 13*a* is configured to partially partition the section where the side water path 13*v* is connected to the annular cooling water path 13*f*.

Specifically, the partial partition 14*a* is configured to extend in the axial direction of the shaft 14 (see FIG. 1) to block the shortest path between the water 13*h* and the water path outlet 13*j* and is configured to partially partition a water path between the water path inlet 13*h* and the water path outlet 13*j*, where the side water path 13*v* joins the annular cooling water path 13*f*. The partition wall 14*a* may be arranged at the above-described position, which does not to block the inlet side water path 13*w* and the outlet side water path 13*x*. An unclosed section 14*b* is on extension of the partial partition 13*a* on the annular cooling water path 13*f* side and forms a passage for the cooling water.

The following relationship is set, HS/HT=0.2~0.8, where HS is a height of the partial partition 14*a* in the axial direction and HT is a height of the annular cooling water path 13*f* and the side water path 13*v* in the axial direction (the height of the housing cooling water path 60 in the axial direction). HS/HT=0.2 is a value of overlap of the partial partition 13*f* partially overlapping a water path in such a case that the water path is provided to linearly connect the inlet side water path 13*w* and the outlet side water path 13*x*. HS/HT=0.2~0.8 is a value which is set with production variations in mind.

It is preferable that HS=W where W is a width of the side water path 13*v*. With HS=W, the partial partition 14*a* does not project in the annular cooling water path 13*f* so as not to interfere circulation of the cooling water in the annular cooling water path 13*f*.

Figure 4C:
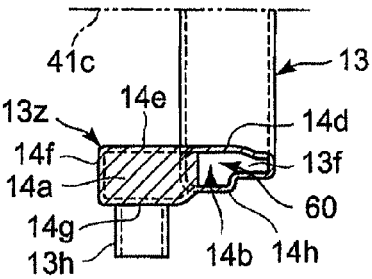
FIG. 4C is a cross-sectional view taken along line c-c of FIG. 3.

FIG. 4C is a cross-sectional view taken along line c-c of FIG. 3. The partial partition 14*a* extends respectively from an inner wall 14*d* of the annular cooling water path 13*f*, an inner wall 14*e* of the port part 13*z*, a side wall 14*f* of the port part 13*z*, an outer wall 14*g* of the port part 13*z* and an outer wall 14*h* of the annular cooling water path 13*f* and is formed integrally in the bearing housing 13. The partial partition 14*a* is configured to partially close the housing cooling water path 60.

Specifically, the partial partition 14*a* extends outward toward the annular cooling water path 13*f* from the side wall 14*f* of the port part 13*z*.

Operation of the cooling structure for the bearing housing as described above is now explained in reference to FIG. 5 to FIG. 10.

Figure 5A:
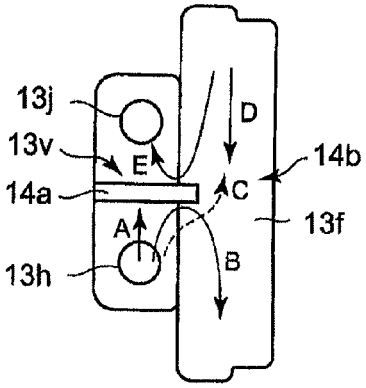
FIG. 5A is an illustration of cooling effect by forced circulation of cooling water of the cooling structure for the bearing housing according to a first embodiment of the present invention.
Figure 5B:
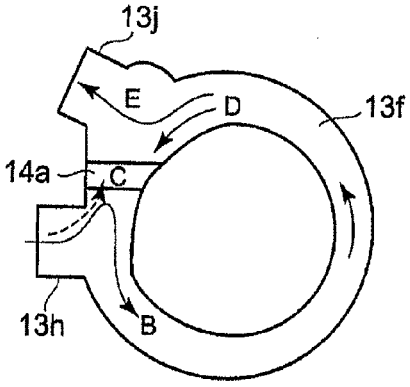
FIG. 5B is an illustration of cooling effect by forced circulation of cooling water of the cooling structure for the bearing housing according to a first embodiment of the present invention.
Figure 6A:
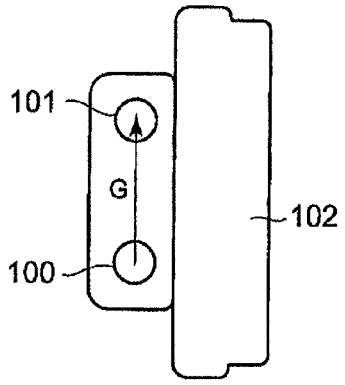
FIG. 6A is an illustration of cooling effect by forced circulation of cooling water of the cooling structure for the bearing housing according to a first comparative example.
Figure 6B:
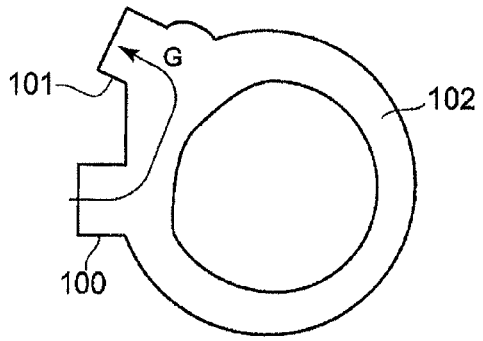
FIG. 6B is an illustration of cooling effect by forced circulation of cooling water of the cooling structure for the bearing housing according to a first comparative example.
Figure 7A:
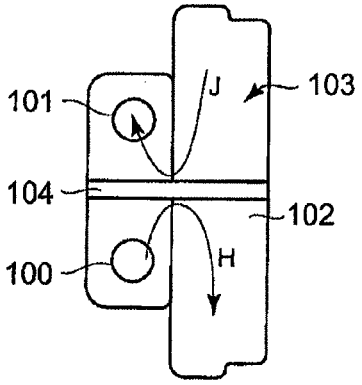
FIG. 7A is an illustration of cooling effect by forced circulation of cooling water of the cooling structure for the bearing housing according to a second comparative example.
Figure 7B:
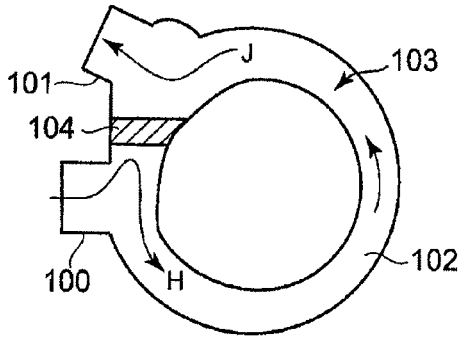
FIG. 7B is an illustration of cooling effect by forced circulation of cooling water of the cooling structure for the bearing housing according to a second comparative example.
Figure 8A:
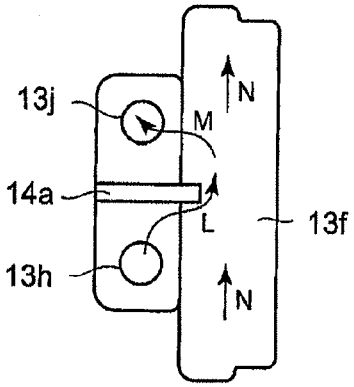
FIG. 8A is an illustration of cooling effect by natural convection of the cooling structure for the bearing housing according to the first embodiment of the present invention.
Figure 8B:
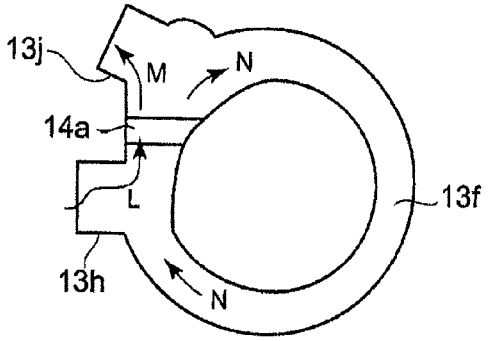
FIG. 8B is an illustration of cooling effect by natural convection of the cooling structure for the bearing housing according to the first embodiment of the present invention.
Figure 9A:
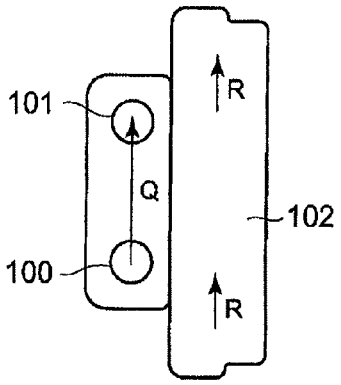
FIG. 9A is an illustration of cooling effect by natural convection of the cooling structure for the bearing housing according to the first comparative example.
Figure 9B:
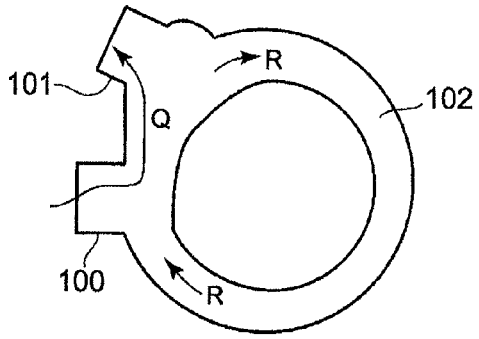
FIG. 9B is an illustration of cooling effect by natural convection of the cooling structure for the bearing housing according to the first comparative example.
Figure 10A:
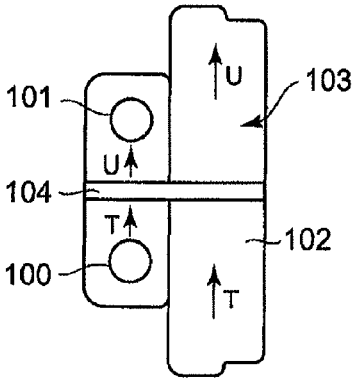
FIG. 10A is an illustration of cooling effect by natural convection of the cooling structure for the bearing housing according to the second comparative example.
Figure 10B:
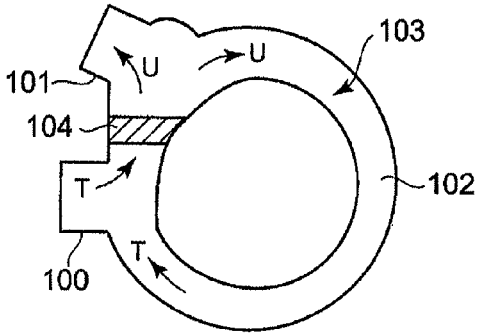
FIG. 10B is an illustration of cooling effect by natural convection of the cooling structure for the bearing housing according to the second comparative example.

FIG. 5 to FIG. 7 illustrate the state where a water pump is operated during engine operation and the cooling water is supplied to the water path inlet of the bearing housing in a forced manner by the water pump. FIG. 8 to FIG. 10 illustrate the state where the water pump is stopped during engine shutdown and the cooling water is not supplied to the water path inlet. FIG. 5A, FIG. 6A, FIG. 7A, FIG. 8A, FIG. 9A and FIG. 10A correspond to FIG. 4B, and FIG. 5B, FIG. 6B, FIG. 7B, FIG. 8B, FIG. 9B and FIG. 10B correspond to FIG. 4A.

In a first embodiment illustrated in FIG. 5A and FIG. 5B, as indicated by an arrow A, the cooling water entering the side water path 13*v* through the water path inlet 13*h* is blocked by the partial partition 14*a* from flowing linearly to the water path outlet 13*j* and, as indicated by an arrow B, the cooling water hits the partial partition 14*a* to change its direction and flows downward in the annular cooling water path 13*f*. Further, as indicated by a dotted arrow C, the cooling water partially flows to the unclosed section 14*b* on a tip side of the partial partition 14*a*.

A part of the cooling water having circulated the annular cooling water path 13*f* continues to circulate as indicated by an arrow D, while the rest of the cooling water hits the partial partition 14*a* to change its direction to flow upward and then discharged through the water path outlet 13*j* as indicated by an arrow D.

In a first comparative example illustrated in FIG. 6A and FIG. 6B, there is no partial partition between a water path inlet 100 and a water path outlet 101 and thus, the cooling water entering an annular cooling water path 102 through the water path inlet 100 flows directly to the water path outlet 101 in the shortest path as indicated by an arrow G, and then is discharged through the water path outlet 101. As a result, the cooling water does not circulate in the annular cooling water path 102.

In a second comparative example illustrated in FIG. 7A and FIG. 7B, a partition 104 is provided between a water path inlet 100 and a water path outlet 101. The partition 104 is configured to completely close a housing cooling water path 103 composed of a water path on the water path inlet 100 side, a water path on the water path outlet 101 side and an annular cooling water path 102. Thus, the cooling water entering the housing cooling water path 103 through the water path inlet 100 hits the partition 104 to change its direction as indicted by an arrow H, and flows downward in the annular cooling water path 102 to circulate in the annular cooling water path 102. Then, the cooling water hits the partition 104 to change its direction and flows upward to be discharged from the water path outlet 101.

In the first embodiment illustrated in FIG. 8A and FIG. 8B, as indicated by arrows L, M, the cooling water flows by natural convection from the water path inlet 13*h* and flows around the partial partition 14*a* toward the water path outlet 13*j* disposed above the water path inlet 13*h*. Further, in addition to the effect of the above natural convection, natural convection within the annular cooling water path 13*f* occurs in the direction from a lower part to an upper part of the annular cooling water path 13*f*. As a result, as indicated by arrows N, N, significant cooling water circulation of a relatively large amount is generated to maintain the cooling performance.

In the first comparative example illustrated in FIG. 9A and FIG. 9B, there is no partial partition between the water path inlet 100 and the water path outlet 101 and thus, by natural convection, the cooling water flows, as indicated by an arrow Q, in the shortest path from the water path inlet 100 side to the water path outlet 101 side disposed above the water path inlet 100.

Further, by the natural convection of the cooling water in the annular cooling water path 102 from the lower part to the upper part, cooling water circulation is generated as indicated by arrows R, R. However, by the natural convection in the annular cooling water path 102 alone, it is difficult to circulate the cooling water compared to the first embodiment illustrated in FIG. 8A and FIG. 8B.

In the second comparative example illustrated in FIG. 10A and FIG. 10B, the partition 104 completely closes the housing cooling water path 103 and thus, natural convection occurs locally in water paths above and below the partition 104 as indicated by arrows U, U and arrows T, T, respectively. As a result, it is difficult to circulate the cooling water compared to the first embodiment illustrated in FIG. 8A and FIG. 8B.

As explained in reference to FIG. 5A, FIG. 5B, FIG. 8A and FIG. 8B, by providing the partial partition 14*a* in the first embodiment, in comparison with the first comparative example illustrated in FIG. 6A, FIG. 6B, FIG. 9A and FIG. 9B and the second comparative example illustrated in FIG. 7A, FIG. 7B, FIG. 10A and FIG. 10B, it is possible to secure the forced water circulating amount in the annular cooling water path 13*f* when the water pump is operated, and to perform sufficient cooling water circulation by natural convection in the annular cooling water path 13*f* when the water pump is stopped. Therefore, it is possible to enhance the cooling performance of cooling the bearing housing 13 (see FIG. 2) and the sliding parts of the journal bearings 52, 53 (see FIG. 2) and to avoid the heat soak-back phenomenon.

By partially closing the annular cooling water path 13*f* and the side water path 13*v* by the partial partition 14*a*, in the case of producing the bearing housing 13 by casting and forming the annular cooling water path 13*f* using a sand mold core, core sand can be easily removed by shot blasting.

Therefore, it is possible to improve the productivity of the bearing housing 13 and to reduce the cost.

Further, it is possible to easily remove the air mixed in the side water path 13*v*, the annular cooling water path 13*f*, and the like between the water path inlet 13*h* and the water path outlet 13*j* from the unclosed section 14*b* (see FIG. 4B). As a result, reduction in cooling ability caused by air entrainment can be avoided to secure the cooling performance.

Second Embodiment

Figure 11A:
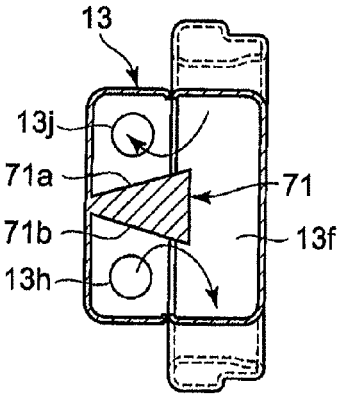
FIG. 11A is a cross-view of an overall structure of the cooling water path of the cooling structure for the bearing housing according to the second embodiment of the present invention.

As illustrated in FIG. 11A, a partial partition 71 has flat inclined faces 71*a*, 71*b* on both sides. By these inclined faces 71*a*, 71*b*, the cooling water is effectively directed, as indicated by arrows, to the annular cooling water path 13*f* from the water path inlet 13*h*, or to the water path outlet 13*j* from the annular cooling water path 13*f* so as to facilitate circulation of the cooling water in the annular cooling water path 13*f*.

Figure 11B:
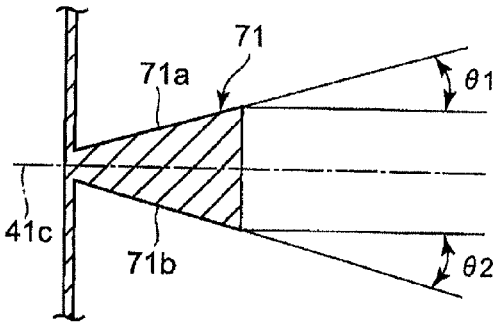
FIG. 11B is a cross-sectional view of a main section of a partial partition of the cooling structure for the bearing housing according to the second embodiment of the present invention.

As illustrated in FIG. 11B, the inclined faces 71*a*, 71*b* are configured to incline relative to the axis 41*c* of the shaft 41 (see FIG. 1) at angles θ1, θ2. The angles θ1, θ2 are arbitrarily set, taking into account the circulating amount of the cooling water in the annular cooling water path 13*f*.

Third Embodiment

Figure 12:
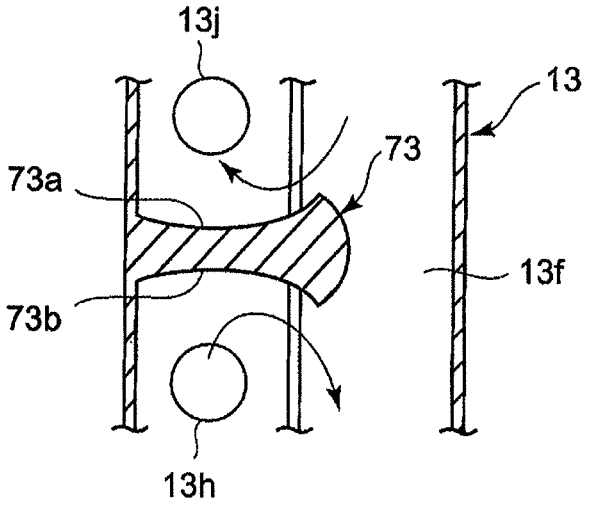
FIG. 12 is a cross-sectional view of a main section of the partial partition according to a third embodiment of the present invention.

As illustrated in FIG. 12, a partial partition 73 has inclined faces 73*a*, 73*b* formed on both sides. The inclined faces 73*a*, 73*b* are formed of a curved surface having one or more than one curvature radius. By these inclined faces 73*a*, 73*b*, the cooling water is effectively directed, as indicated by arrows, to the annular cooling water path 13*f* from the water path inlet 13*h*, or to the water path outlet 13*j* from the annular cooling water path 13*f* while suppressing separation so as to facilitate circulation of the cooling water in the annular cooling water path 13*f*.

Fourth Embodiment

Figure 13A:
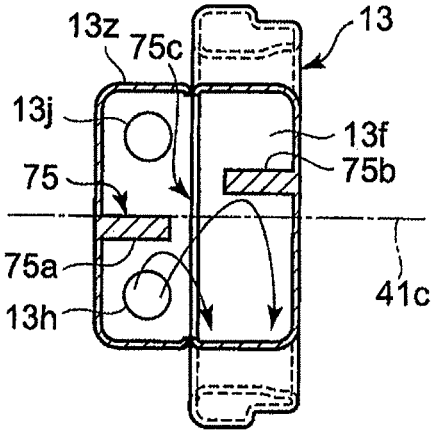
FIG. 13A is a cross-sectional view of the cooling structure for the bearing housing according to a fourth embodiment of the present invention.

As illustrated in FIG. 13A, a partial partition 75 is divided into a first partition 75*a* projecting toward the annular cooling water path 13*f* from the port part 13*z* and a second partition 75*b* projecting toward the port part 13*z* from the annular cooling water path 13*f*. The first partition 75*a* and the second partition 75*b* both extend along the axis 41*c*, and between the first partition 75*a* and the second partition 75*b*, an unclosed section 75*c* is provided.

The first partition 75*a* and the second partition 75*b* are not aligned. Thus, the cooling water hits the first partition 75*a* and the second partition 75*b* to change its flow direction as indicated by arrows, which substantially coincide with each other. As a result, it is possible to facilitate circulation of the cooling water in the annular cooling water path 13*f*.

Fifth Embodiment

Figure 13B:
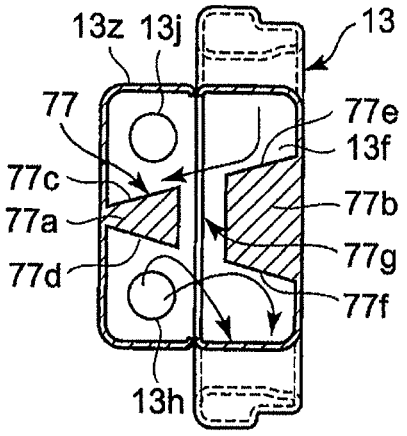
FIG. 13B is a cross-sectional view of the cooling structure for the bearing housing according to a fifth embodiment of the present invention.

As illustrated in FIG. 13B, a partial partition 77 is divided into a first partition 77*a* projecting toward the annular cooling water path 13*f* from the port part 13*z* and a second partition 77*b* projecting toward the port part 13*z* from the annular cooling water path 13*f*. Between the first partition 77*a* and the second partition 77*b*, an unclosed section 77*g* is provided.

The first partition 77*a* has flat inclined faces 77*c*, 77*d* formed on both sides. The second partition 77*b* has flat inclined faces 77*e*, 77*f* formed on both sides. The inclined face 77*c* of the first partition 77*a* and the inclined face 77*e* of the second partition 77*b* are in the same plane, and the inclined face 77*d* of the first partition 77*a* and the inclined face 77*f* of the second partition 77*b* are in the same plane.

With this configuration, it is possible to further facilitate the cooling water flow to the annular cooling water path 13*f* from the water path inlet 13*h* and to the water path outlet 13*j* from the annular cooling water path 13*f*.

Sixth Embodiment

Figure 14A:
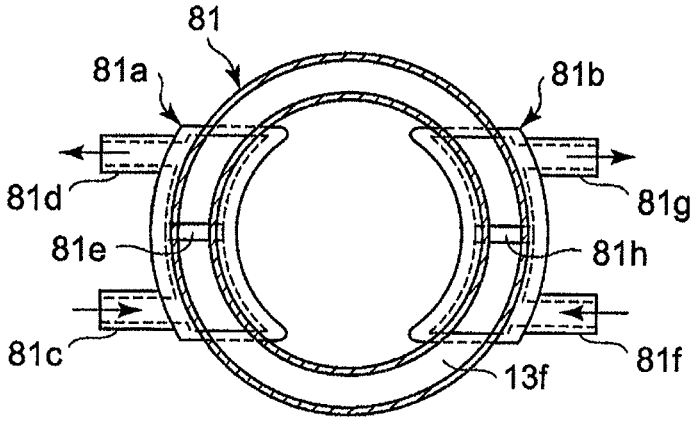
FIG. 14A is a cross-sectional view of the cooling structure for the bearing housing according to a sixth embodiment of the present invention.

As illustrated in FIG. 14A, as a plurality of the port parts, a first port part 81*a* and a second port part 81*b* are formed in the bearing housing 81. In the first port part 81*a*, a water path inlet 81*c*, a water path outlet 81*d* and a partial partition 81*e* are provided. In the second port part 81*f*, a water path outlet 81*g* and a partial partition 81*h* are provided.

Figure 14B:
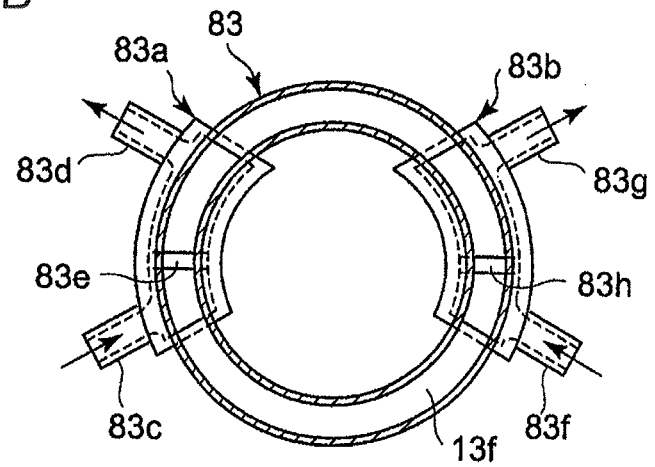
FIG. 14B is a cross-sectional view of the cooling structure for the bearing housing according to a seventh embodiment of the present invention.

By providing a plurality of the port part, i.e. the first port part 81*a* and the second port part 81*b*, it is possible to select either one of the first port part 81*a* and the second port part 81*b*, that has the partial partition 81*e* or 81*h* with higher effect (the facilitation effect of facilitating the cooling water circulation in the annular cooling water path 13*f*, which is different for each port part due to production variations Seventh Embodiment As illustrated in FIG. 14B, as a plurality of the port parts, a first port part 83*a* and a second port part 83*b* are formed in a bearing housing 83. A water path inlet 83*c* and a water path outlet 83*d* of the first port part 83*a* and a water path inlet 83*f* and a water path outlet 83*g* of the second port part 83*b* are arranged in a fashion that is different from the water path inlet 81*c*, the water path outlet 81*d*, the water path inlet 81*f* and the water path outlet 81*g* as illustrated in FIG. 14A.

Further, a partial partition 83*e* is provided in the first port part 83*a*, and a partial partition 83*h* is provided in the second port part 83*b*.

As illustrated in the drawing, the water path inlets 83*c*, 83*f* are directed toward the partial partitions 83*e*, 83*h*, respectively. This makes it easy for the cooling water to hit the partial partitions 83*e*, 83*h*. As a result, the cooling water can easily flow toward the annular cooling water path 13*f*, and the cooling water circulation in the annular cooling water path 13*f* can be facilitated so as to further enhance the cooling performance.

Eighth Embodiment

Figure 14C:
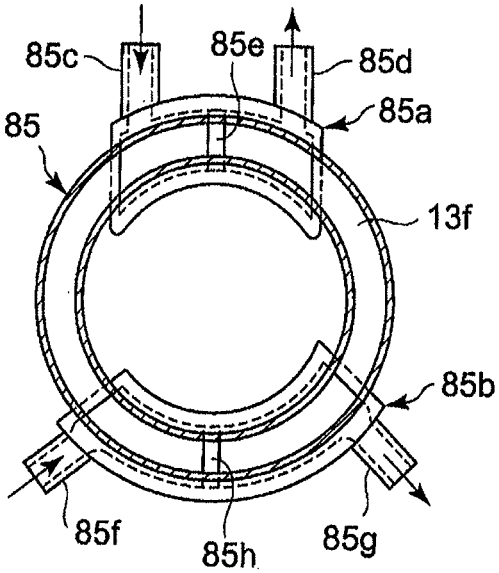
FIG. 14C is a cross-sectional view of the cooling structure for the bearing housing according to an eighth embodiment of the present invention.

As illustrated in FIG. 14C, a first port part 85*a* and a second port part 85*b* are formed in the bearing housing 85 on an upper side and a lower side of the annular cooling water path 13*f*.

In the first port 85*a*, a water path inlet 85*c*, a water path outlet 85*d* and a partial partition 85*e* are provided. In the second port 85*b*, a water path inlet 85*f*, a water path outlet 85*g* and a partial partition 85*h* are provided.

By providing the first port part 85*a* and the second port part 85*b* in the upper and lower parts of the bearing housing 85, it is possible to select a connecting location of cooling water piping depending on an engine to which the turbocharger is mounted. This facilitates connection of the cooling water piping.

In fourth and fifth embodiments illustrated in FIG. 13A and FIG. 13B, the partial partition 55, 57 is divided into two sections. This is, however, not restrictive and the partial partition 55, 57 may be divided into more sections, e.g. three or four sections.

Further, as illustrated in FIG. 4B and FIG. 4C, the side water path 13*v* is arranged to be offset in the extension direction of the axis 41*c* with respect to the annular cooling water path 13*f*. This is, however, not restrictive and the side water path 13*v* may be arranged to be offset with respect to the annular cooling water path 13*f* in both the extension direction of the axis 41*c* and a radial direction of the annular cooling water path 13*f*.

INDUSTRIAL APPLICABILITY

The present invention is suitable for cooling the bearing housing for the turbocharger.

REFERENCE SIGNS LIST

10 Turbocharger
13, 81, 83, 85 Bearing housing
13*f* Annular cooling water path
13*h*, 81*c*, 81*f*, 83*c*, 83*f*, 85*c*, 85*f* Water path inlet
13*j*, 81*d*, 81*g*, 83*d*, 83*g*, 85*d*, 85 Water path outlet
14*a*, 71, 73, 77, 81*e*, 81*h*, 83*e*, 83*h*, 85*e*, 85*h* Partial partition
16 Turbine housing
17 Turbine rotor
32 Compressor housing
33 Compressor rotor
41 Shaft
52, 53 Journal bearing
54 Thrust bearing
55 Thrust sleeve
56 Thrust bearing
71*a*, 71*b*, 73*a*, 73*b*, 77*c*, 77*d*, 77*e*, 77*f* Inclined face
HS Height of Partial partition in the axial direction
HT Height of Water path in the axial direction (Height of Housing cooling water path in the axial direction)

The invention claimed is:

1. A cooling structure for a bearing housing for a turbocharger in which a turbine housing for housing a turbine rotor is attached to a compressor housing for housing a compressor rotor via the bearing housing, the turbine rotor and the compressor is connected by a shaft and the shaft is rotatably supported via the bearing in the bearing housing, the cooling structure comprising:

an annular cooling water path formed in the bearing housing and surrounding the shaft and the bearing so as to cool the bearing housing and the bearing with cooling water flowing in the annular cooling water path;

a water path inlet provided in the bearing housing to communicate with the annular cooling water path, the cooling water being supplied to the annular cooling water path from the water path inlet;

a water path outlet provided in the bearing housing to communicate with the annular cooling water path, the cooling water being discharged from the water path outlet;

a side water path arranged to be offset in an axial direction of the shaft with respect to the annular cooling water path, in the side water path, the water path inlet and the water path outlet being provided, and the side water path communicating the water path inlet and the water path outlet so as to form a shortest path along a circumferential direction of the shaft inside the side water path; and a partial partition for partially closing a water path disposed between the water path inlet and the water path outlet, wherein the partial partition is arranged in the shortest path of the water path between the water path inlet and the water path outlet; and wherein the partial partition is arranged at a height in the flow path formed by the annular cooling water path and the side water path, the height being 20 to 80% of an axial height of the flow path along the axial direction of the flow path.

2. The cooling structure for the bearing housing for the turbocharger according to claim 1, wherein the partial partition is configured to almost completely close the side water path at said axial height.

3. The cooling structure for the bearing housing for the turbocharger according to claim 1, wherein the partial partition has an inclined face inclining relative to the axial direction of the shaft so as to facilitate a flow of the cooling water to the annular cooling water path from the water path inlet or to the water path outlet from the annular cooling path.

4. A cooling structure for the bearing housing for the turbocharger in which a turbine housing for housing a turbine rotor is attached to a compressor housing for housing a compressor rotor via the bearing housing, the turbine rotor and the compressor is connected by a shaft and the shall is rotatably supported via the bearing in the bearing housing, the cooling structure comprising:

an annular cooling water path formed in the bearing housing and surrounding the shaft and the bearing so as to cool the bearing housing and the bearing with cooling water flowing in the annular cooling water path;

a water path inlet provided in the bearing housing to communicate with the annular cooling water path, the cooling water being supplied to the annular cooling water path from the water path inlet;

a water path outlet provided in the bearing housing to communicate with the annular cooling water path, the cooling water being discharged from the water path outlet; and a partial partition for partially closing a water path disposed between the water path inlet and the water path outlet, wherein plural sets of the water path inlet and the water path outlet are provided, and the partial partition is provided in each of the plural sets of the water path inlet and the water path outlet.

5. A cooling structure for the bearing housing for the turbocharger in which a turbine housing for housing a turbine rotor is attached to a compressor housing for housing a compressor rotor via the bearing housing, the turbine rotor and the compressor is connected by a shaft and the shaft is rotatably supported via the bearing in the bearing housing, the cooling structure comprising:

an annular cooling water path formed in the bearing housing and surrounding the shaft and the bearing so as to cool the bearing housing and the bearing with cooling water flowing in the annular cooling water path;

a water path inlet provided in the bearing housing to communicate with the annular cooling water path, the cooling water being supplied to the annular cooling water path from the water path inlet;

a water path outlet provided in the bearing housing to communicate with the annular cooling water path, the cooling water being discharged from the water path outlet; and a partial partition for partially closing a water path disposed between the water path inlet and the water path outlet, wherein the partial partition is arranged in the shortest path of the water path between the water path inlet and the water path outlet, and wherein the partial partition is divided into a plurality of sections.

* * * * *